US011684189B2

(12) United States Patent
Beuerlein

(10) Patent No.: US 11,684,189 B2
(45) Date of Patent: Jun. 27, 2023

(54) EATING AID

(71) Applicant: Erna Beuerlein, Pforzheim (DE)

(72) Inventor: Erna Beuerlein, Pforzheim (DE)

( * ) Notice: Subject to any disclaimer, the term of this patent is extended or adjusted under 35 U.S.C. 154(b) by 34 days.

(21) Appl. No.: 17/124,976

(22) Filed: Dec. 17, 2020

(65) Prior Publication Data

US 2021/0186242 A1 Jun. 24, 2021

(30) Foreign Application Priority Data

Dec. 18, 2019 (DE) ..... 20 2019 107 070.6

(51) Int. Cl.
*A47G 21/00* (2006.01)

(52) U.S. Cl.
CPC ..... *A47G 21/001* (2013.01)

(58) Field of Classification Search
CPC ..... A47G 21/001; A47G 21/00
USPC ..... 294/25
See application file for complete search history.

(56) References Cited

U.S. PATENT DOCUMENTS 1,230,683 A * 6/1917 Daly ..... A47L 13/18 D3/29
1,755,014 A * 4/1930 Morrison ..... A61F 13/105 2/21
1,761,356 A * 6/1930 McNamara ..... A61F 13/105 2/21
1,847,345 A * 3/1932 Longstreet ..... A47G 21/001 294/131
3,010,500 A 11/1961 Jordan
4,796,302 A * 1/1989 Davis ..... A41D 19/01517 2/21
D312,757 S * 12/1990 Zwang ..... D7/683
5,588,214 A * 12/1996 Nelson ..... B26B 27/007 30/298
6,374,417 B1 * 4/2002 Stagnitta ..... A41D 19/01547 2/163
D459,808 S * 7/2002 Safieh ..... D24/152
2007/0118947 A1 * 5/2007 Lorenzo ..... B42D 9/04 2/21
2013/0277993 A1 * 10/2013 Zimmermann ..... A47G 21/001 294/25

FOREIGN PATENT DOCUMENTS

| | | | |
|---|---|---|---|
| CA | 2927131 | A1 | 4/2014 |
| CN | 201718945 | U | 1/2011 |
| DE | 202014001520 | U1 | 9/2014 |
| DE | 10 2013 009 978 | A1 | 12/2014 |
| JP | 3-68846 | U | 7/1991 |

(Continued)

OTHER PUBLICATIONS

Amazon, 2 Pieces Portable Titanium Toothpicks Pocket Toothpick Metal Toothpick Holder for Outdoor Picnic and Camping (Silver), Jul. 1, 2019, https://www.amazon.com/Portable-Titanium-Toothpicks-Toothpick-Outdoor/dp/B07TWMG6RM?th=1. (Year: 2019).*

*Primary Examiner* — Stephen A Vu
(74) *Attorney, Agent, or Firm* — Birch, Stewart, Kolasch & Birch, LLP

(57) ABSTRACT

An eating aid has a contact area for placing against a food item and a finger receiver facing away from the contact area for attachment to a finger. Herein, it is provided that at least one spike protrudes from the contact area serving to be inserted into the food item.

19 Claims, 2 Drawing Sheets

(56) References Cited

FOREIGN PATENT DOCUMENTS

| | | | |
|---|---|---|---|
| JP | 2018-50713 | A | 4/2018 |
| KR | 10-2011-0002908 | A | 1/2011 |
| KR | 10-2012-0017110 | A | 2/2012 |
| KR | 20-2015-0001398 | U | 4/2015 |

* cited by examiner

EATING AID

BACKGROUND OF THE INVENTION

1. Field of the Invention

The invention relates to an eating aid for more comfortably gripping fast food and finger food, such as hamburgers, in particular, according to the preamble of claim 1. To achieve this, the eating aid has a contact area for placing against the surface of a food item as well as a finger receiver facing away from the contact area for attachment to an individual finger or thumb. This enables gripping the food item without the concerned finger or thumb coming into direct contact with the surface of the food item.

2. Description of Related Art

DE102013009978A1 describes a finger pulp protector for eating fast food. It consists of several thimbles made of a thermally insulating, liquid-repellent and grease-repellent material. This enables a user to hold even hot finger food without any pain, with the thimbles also preventing the concerned fingers becoming dirty.

A disadvantage of such known eating aids is that they only enable insufficient gripping of food items with stuffing or fillings, such as hamburgers, hot dogs or sandwiches, in particular, having an outer bun or outer slices of bread with one or more layers of meat, cheese and/or vegetables or lettuce leaves received therein. In doing so, as with a lack of use of eating aids when holding and eating such food items, the layers of fillings frequently shift and partially or wholly escape from the bun or bread and cause contamination.

SUMMARY OF THE INVENTION

The object of the invention is to prevent the recited disadvantages and enable comfortable holding of food items with fillings, such as hamburgers, hot dogs or sandwiches, in particular.

This object is achieved by means of an eating aid with the features of claim 1. Herein, at least one spike protrudes from the contact area serving to be inserted into the food item in order to penetrate the various layers and thereby secure them against shifting with respect to the respective other layers or with respect to the bun or bread while eating. Hereby, the food items held with at least one eating aid, and in particular their layers of fillings, can be held relative to one another and with respect to the bun or bread and consumed in such a way as they are arranged during preparation. In order to be able to handle the spike protruding from the eating aid without any issues, the eating aid, or more precisely its finger receiver, is preferably provided for attachment to exactly one finger or thumb.

In a particularly advantageous embodiment, the contact area is formed by a planar element bounding or at least partially forming the finger receiver. Hereby, while inserting the spike into the respective food item and simultaneously placing the contact area against the surface of the food item, the finger or thumb on which the eating aid is held only comes into contact with the food item with the planar element placed therebetween. This enables effectively preventing both pain while consuming hot food items and contamination of the finger by fats, juices, or sauces of the food item, in particular.

Herein, it is favorable if the planar element is arched and shapes a concave area for placement against a finger or thumb. The concave area of the arched element is particularly adapted to the shape of a human finger or thumb and therefore formed in an ergonomic manner. When placing the eating aid against a finger, this enables good wearing comfort and particularly suitable predefined positioning of the arched element on the finger. Herein, it is particularly favorable if the concave area extends essentially completely across a bottom side of the finger end, including the fingertip, and is curved upward at the fingertip towards an end of the respective finger nail for this purpose. Alternatively, the concave area may also be formed by a type of thimble within which the finger end can be received. In any case, in this way, the concerned finger may be shielded from the respective food item in an even better way, and a better fit of the eating aid may be warranted.

Herein, it is favorable if the receiver is additionally bounded by a ring element extending away from the planar element. Due to the ring element, a secure fit of the eating aid on the concerned finger of the user may be warranted.

Advantageously, the spike is held within a portion of the arched element, with the finger receiver forming a fingertip placement surface at the height thereof shaped such that when slipping the eating aid onto a finger, its outermost phalanx abuts the same. Hereby, the user may insert the spike into the surface of the food item in an easier and more controlled fashion using his or her fingertip.

It is also favorable if the eating aid is formed of metal as a single part in order to enable durable and recurrent use. For this purpose, the eating aid may, for example, be made of a silver alloy or have a silver coating.

Alternatively, the eating aid is at least partially made of a single-use material in order to ensure particularly inexpensive manufacturing as well as perfectly hygienic use.

Herein, it is favorable if the single-use material consists of a renewable resource, such as bamboo. This enables environmentally friendly manufacturing of the eating aid. Using a suitable renewable resource, such as bamboo, starch or a wood-based material, such as beechwood, may also warrant sufficient stability and good wearing comfort.

It is further favorable if the spike is made from or in the fashion of a toothpick in order to enable particularly inexpensive manufacturing of the eating aid.

Advantageously, the eating aid can be assembled from several parts in order to be able to manufacture it in an inexpensive way and optionally from different materials. In this way, the planar element and the spike may, for example, be formed of a rigid material, such as a metal and/or a renewable resource, whereas an elastic material is used for the ring element, such as a plastic ring.

In another advantageous embodiment, the eating aid is integrally made as an injection-molded part from a plastic, such as a bioplastic or a compostable material, enabling easy and inexpensive manufacturing in especially large quantities.

It is particularly advantageous if the spike has a length of at least 2 cm in order to be able to securely grip the concerned food items with stuffing or fillings, such as hamburgers, hot dogs or sandwiches, in particular. Thereby, both the outer bun or bread slices and the inner layers of meat, cheese and/or vegetables or lettuce leaves may be securely fixed. Preferably, the spike therefore has a length of 2.5 to 3.5 cm in order to enable both secure gripping and comfortable handling of the eating aid while inserting the spike and while changing the insertion site.

The aforementioned object is further achieved by an arrangement of at least two eating aids in one of the aforementioned embodiments, wherein a first one of those eating aids is provided for fixation to a thumb or shaped and sized accordingly. Herein, the first eating aid is formed separately from at least a second eating aid provided for fixation to another finger, such as an index, middle, ring, or little finger, or shaped and sized accordingly. In this way, the spike formed on the eating aid located at the thumb and the spike of the at least one other eating aid at one of the other fingers can be moved and handled in a relatively unrestricted fashion in relation to one another, such that, despite their length and even with relatively large-sized food items, they can be inserted into two sides facing away from each other without any issues.

Herein, it is favorable if the first eating aid has a different finger receiver with respect to the at least second eating aid. In this way, the first eating aid may, for example, have a larger finger receiver for fixation to the thumb than the second finger receiver which is provided for putting on an index, middle, or ring finger. In any case, the provision of eating aids adapted for the respectively provided finger in terms of shape and size enables particularly secure and comfortable holding and consuming of food items, such as hamburgers, hot dogs, or sandwiches.

Herein, it is particularly advantageous if the eating aids of the arrangement each have exactly one spike in order to enable easy handling when inserting and removing the spikes or when altering their insertion positions.

It is noted that all of the features of the object according to the invention described above are interchangeable or combinable unless interchanging or combining the same is precluded for technical reasons.

BRIEF DESCRIPTION OF THE DRAWINGS

An exemplary embodiment of the invention is depicted in the figures. In the drawings.

DETAILED DESCRIPTION OF THE INVENTION

Figure 1:
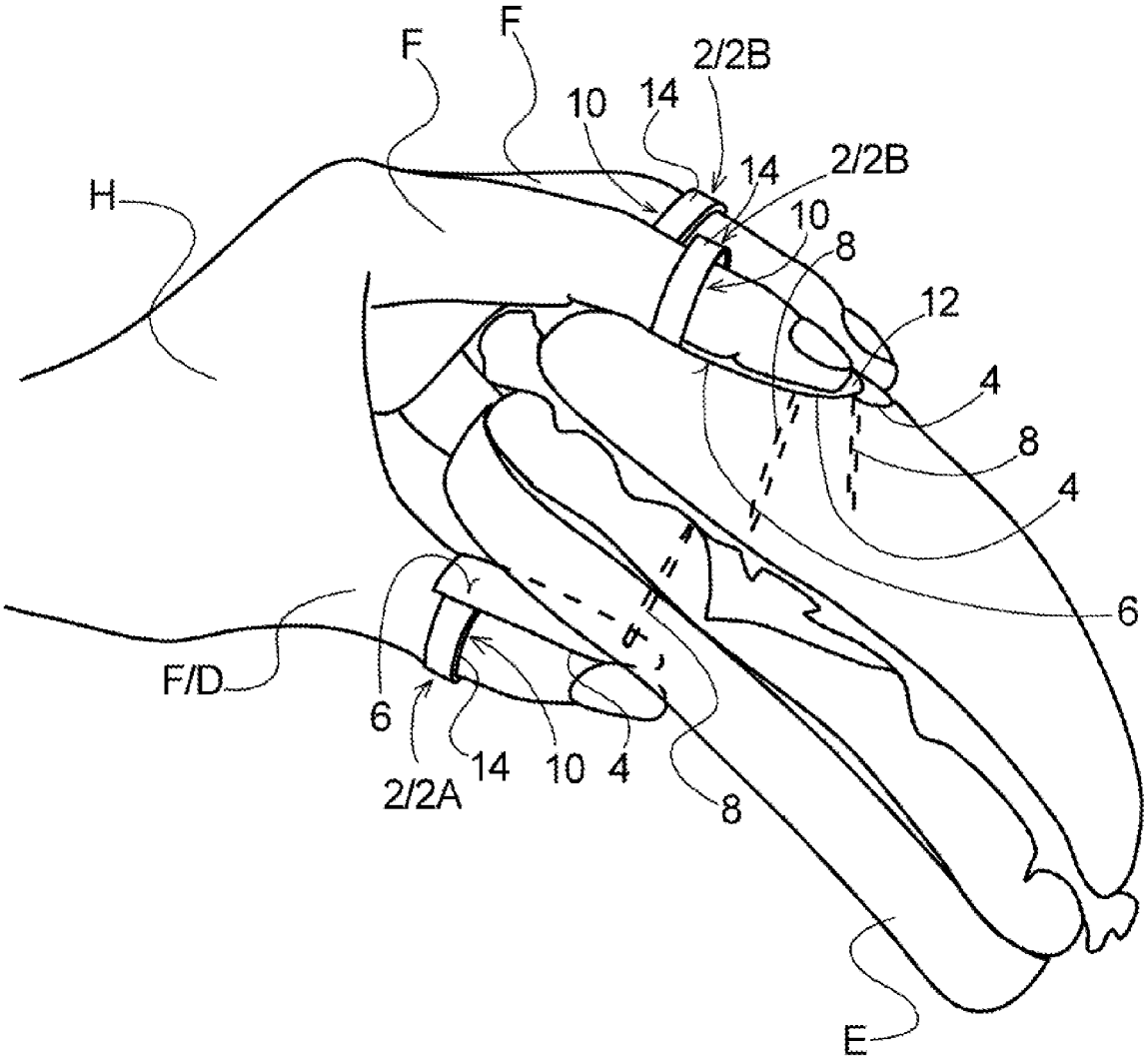
FIG. 1 is a perspective view of an arrangement of eating aids worn on a hand when holding a food item.

FIG. 1 shows a hand H of a user with an arrangement of several separate eating aids 2 slipped onto its finger F and thumb D which serve to better hold a food item E exemplified as a hamburger. For this purpose, each eating aid 2 has a planar element 4 forming a bottom-side contact area 6 which can be placed against a surface of the food item E. A spike 8 protrudes from each contact area 6 serving to penetrate the various layers of the food item E, which consists, for example, of a bun, a meat patty, a cheese layer and/or a lettuce or vegetable layer, and thereby fix the various layers in relation to one another.

Figure 2:
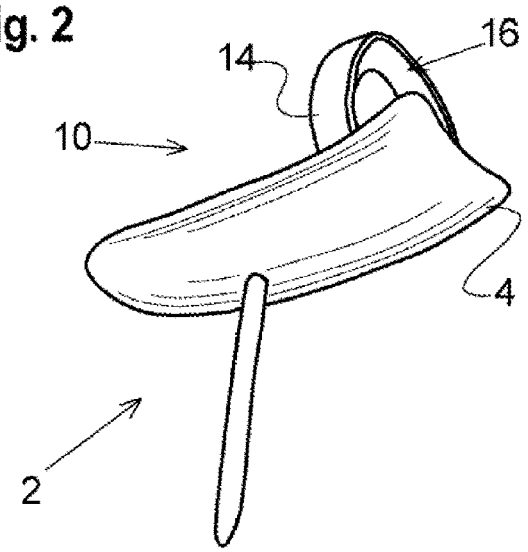
FIG. 2 is a perspective view of one of the eating aids of FIG. 1 towards a contact area.
Figure 3:
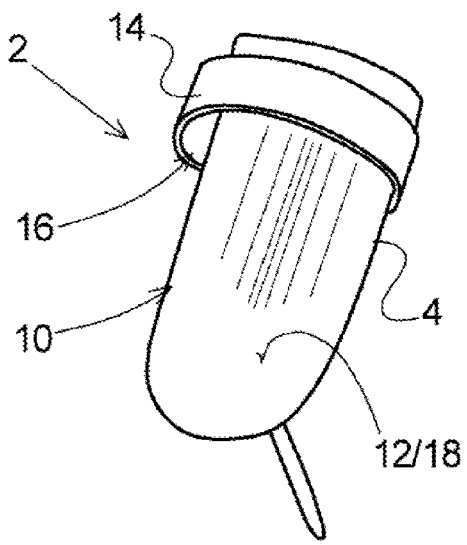
FIG. 3 is a perspective view of the eating aid of FIG. 2 towards a finger receiver.

On a top side 12 facing away from the contact area 6 and the spike 8, the eating aids 2 each have a finger receiver 10, enabling the eating aids 2 to be slipped onto the respective individual finger F or thumb D. As can be seen from FIGS. 2 to 4, the finger receivers 10 are essentially bounded or formed by a ring element 14. Herein, each one of them is attached to or extends away from the planar element 4 such that a circumferentially closed receiver opening 16 is formed which can be pulled onto the concerned finger F or thumb D.

The finger receiver 10 is also bounded by the top side 12 of the planar element 4. As depicted, a concave area 18 may be recessed into it in order to enable more comfortable placing or more stable positioning of the finger F or thumb D.

Figure 4:
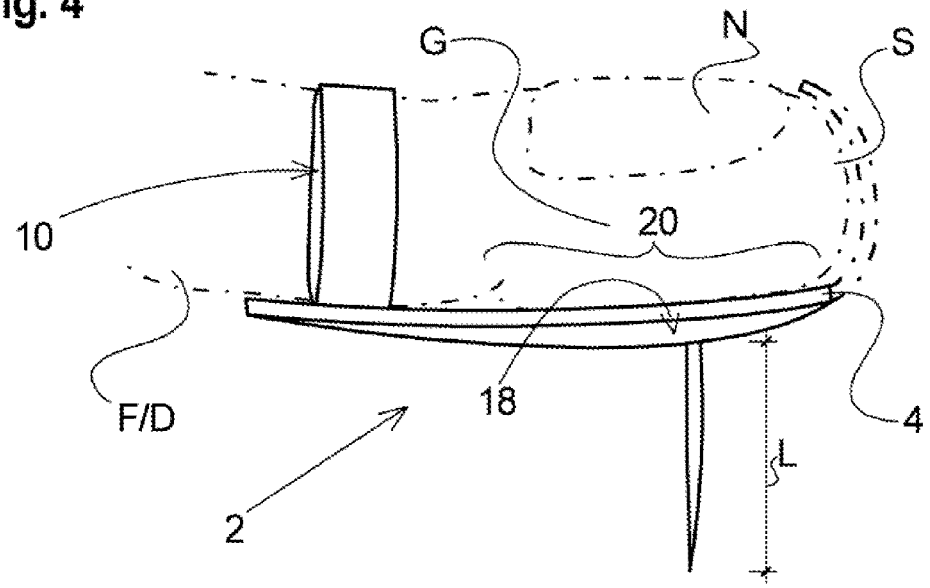
FIG. 4 is a side view of the eating aid of FIG. 2.

As can be seen from FIG. 4, in particular, the spike 8 is held within a portion of the planar element 4, with the finger receiver 10 forming a fingertip placement surface 20 at the height thereof, against which, upon putting the eating aid 2 onto a finger F or thumb D, the fingertip S or outer phalanx G thereof is placed. In this way, the user can handle the spike 8 particularly well and insert it into the food item E with sufficient force. Herein, it is particularly favorable if the concave area 18 extends essentially completely across a bottom side of the outer phalanx G or the finger end, including a fingertip S, and is curved upward at the fingertip S towards an end of the respective finger nail N for this purpose, as depicted by dot-dashed lines in FIG. 4.

In order to be able to warrant comfortable handling when inserting the spikes 8 and fixing the food item E, the individual spikes 8 each have a length L of at least 2 cm, preferably 2.5 to 3.5 cm.

The eating aid 2 or the arrangement of eating aids 2 overall may be made of any known and suitable material. In the case of permanent or repeated use of the eating aid 2, it may at least partially be made of metal, for example, such as a silver alloy, in particular.

Alternatively, the eating aid 2 may at least partially be made of a single-use material for a single use, enabling inexpensive manufacturing, in particular. To achieve this, the eating aid 2 may preferably at least partially be made of a renewable resource, such as starch, a wood-based material, such as beech, or of a bamboo. Herein, it may be provided that the planar element 4, the spike 8 and the ring element 14 are made as separate parts assembled to form the eating aid 2, for example, by bonding or interlocking. For example, a commercially available toothpick may be used as the spike 8. Herein, suitable interlock connection means or receiver areas for an adhesive may be provided on the eating aid 2 (not depicted). The planar element 4 and the spike 8 may also be formed of a rigid material, such as a metal and/or a renewable resource, whereas an elastic material is used for the ring element 14, such as a plastic or rubber ring.

Alternatively, the eating aid 2 may overall or partially, such as to the extent of the planar element 4 and the finger receiver 10, in particular, also be integrally made, for example, as an injection-molded part made of plastic.

Moreover, an arrangement with at least two eating aids 2 may be made available, as depicted in FIG. 1. Herein, a first eating aid 2A is provided for fixation to a thumb D or shaped and sized accordingly and formed separately from at least a second eating aid 2B shaped and sized for fixation to another finger F, such as an index, middle, ring, or little finger.

In any case, the concerned fingers F, D onto which the eating aid 2 has been put may be placed against the food item E with the planar element 4 placed therebetween. In doing so, the fingers F, D are protected from direct temperature application of the food item and, at the same time, the various layers of the food item E are fixed in relation to one another by means of the spikes 8.

It is noted that all of the features of the object according to the invention described above are interchangeable or combinable unless interchanging or combining the same is precluded for technical reasons.

What is claimed is:

1. An eating aid, comprising:

a contact area for placing against a food item, the contact area having a top surface, a bottom surface and a pair of side edges; and a finger receiver facing away from the contact area for attachment to a finger, wherein exactly one spike protrudes from the contact area serving to be inserted into the food item, wherein the one spike has a length of at least 2 cm, and wherein the eating aid is integrally made as an injection-molded part.

2. The eating aid according to claim 1, wherein the contact area is formed by a planar element bounding the finger receiver.

3. The eating aid according to claim 2, wherein the finger receiver is additionally bounded by a ring element extending away from the planar element.

4. The eating aid according to claim 1, wherein the eating aid is at least partially made of metal.

5. The eating aid according to claim 1, wherein the eating aid is at least partially made of a single-use material.

6. The eating aid according to claim 5, wherein the single-use material consists of a renewable resource.

7. The eating aid according to claim 5, wherein the at least one spike is made from a toothpick.

8. The eating aid according to claim 1, wherein the eating aid can be assembled from several parts.

9. An arrangement of at least two of the eating aids according to claim 1, wherein a first eating aid is provided for fixation to a thumb, the first eating aid being formed separately from at least a second eating aid provided for fixation to another finger.

10. The arrangement according to claim 9, wherein the first eating aid has a different finger receiver with respect to the at least a second eating aid.

11. The eating aid according to claim 1, wherein the spike has a length of from 2.5 to 3.5 cm.

12. The eating aid according to claim 1, wherein the finger receiver includes a concave area for receiving the finger, and wherein the concave area of the finger receiver is curved upward at a fingertip portion thereof towards an end of a finger nail for covering a fingertip.

13. The eating aid according to claim 1, wherein the pair of side edges extend in a first direction and the spike extends in a second direction, and wherein the finger receiver is offset from the one spike in the first direction.

14. An eating aid, comprising:

a contact area for placing against a food item; and a finger receiver facing away from the contact area for attachment to a finger, wherein exactly one spike protrudes from the contact area serving to be inserted into the food item, and wherein the one spike has a length of at least 2 cm, and wherein the contact area is formed by a planar element bounding the finger receiver wherein the planar element shapes a concave area for placement against a finger.

15. The eating aid according to claim 14, wherein the finger receiver is additionally bounded by a ring element extending away from the planar element.

16. The eating aid according to claim 14, wherein the spike is held within a portion of the planar element, with the finger receiver forming a fingertip placement surface at a height thereof.

17. An eating aid, comprising:

a contact area for placing against a food item, the contact area having a top surface, a bottom surface and a pair of side edges; and a finger receiver facing away from the contact area for attachment to a finger, wherein exactly one spike protrudes from the contact area serving to be inserted into the food item, wherein the one spike has a length of at least 2 cm, wherein the contact area is formed by a planar element bounding the finger receiver, and wherein the spike is held within a portion of the planar element, with the finger receiver forming a fingertip placement surface at a height thereof.

18. An eating aid, comprising:

a contact area for placing against a food item, the contact area having a top surface, a bottom surface and a pair of side edges; and a finger receiver facing away from the contact area for attachment to a finger, wherein at least one spike protrudes from the contact area serving to be inserted into the food item, and wherein the at least one spike is made from a toothpick.

19. The eating aid according to claim 18, wherein the pair of side edges extend in a first direction and the spike extends in a second direction, and wherein the finger receiver is offset from the at least one spike in the first direction.

* * * * *